US011879462B2

(12) United States Patent
Yoon

(10) Patent No.: US 11,879,462 B2
(45) Date of Patent: Jan. 23, 2024

(54) MOINEAU PUMP-TYPE QUANTITATIVE LIQUID-DISCHARGING APPARATUS

(71) Applicant: Hyuk Beom Yoon, Ansan-si (KR)

(72) Inventor: Hyuk Beom Yoon, Ansan-si (KR)

( * ) Notice: Subject to any disclaimer, the term of this patent is extended or adjusted under 35 U.S.C. 154(b) by 0 days.

(21) Appl. No.: 17/787,931

(22) PCT Filed: Jun. 4, 2020

(86) PCT No.: PCT/KR2020/007274
§ 371 (c)(1),
(2) Date: Jun. 21, 2022

(87) PCT Pub. No.: WO2021/137364
PCT Pub. Date: Jul. 8, 2021

(65) Prior Publication Data

US 2023/0024160 A1 Jan. 26, 2023

(30) Foreign Application Priority Data

Dec. 30, 2019 (KR) ..... 10-2019-0178484

(51) Int. Cl.
*F01C 1/00* (2006.01)
*F03C 2/00* (2006.01)
(Continued)

(52) U.S. Cl.
CPC ..... *F04C 2/1073* (2013.01); *F04C 2/1071* (2013.01); *F04C 15/0061* (2013.01); *F04C 2240/50* (2013.01)

(58) Field of Classification Search
CPC .... F04C 2/1071; F04C 2/1073; F04C 2/1075; F04C 15/0061; F04C 15/0065;
(Continued)

(56) References Cited

U.S. PATENT DOCUMENTS 1,892,217 A 12/1932 Moineau
2,028,407 A 1/1936 Moineau
(Continued)

FOREIGN PATENT DOCUMENTS

JP H0475175 U 6/1992
JP 2008223492 A 9/2008
(Continued)

OTHER PUBLICATIONS

KR970004921B1—Nameny—Flexible Coupling for Joining a Driving Member to a Driven Member Q—Apr. 8, 1997—the English Machine Translation (Year: 1997).*
(Continued)

*Primary Examiner* — Theresa Trieu
(74) *Attorney, Agent, or Firm* — Rabin & Berdo, P.C.

(57) ABSTRACT

The present invention relates to a Moineau pump-type quantitative liquid-discharging apparatus including a stator in which a slot hole is formed, a main shaft including a first shaft part and a second shaft part, which are eccentric with respect to each other, and a rotor which extends from the first shaft part and is inserted into the slot hole, first and second slide bearings to which the first shaft part and the second shaft part are rotatably coupled, respectively, and first and second sliders which guide the first and second slide bearings to move in directions to cross each other, wherein the movement directions of the first and second slide bearings are perpendicular to an extension direction of the rotor.

10 Claims, 6 Drawing Sheets

(51) Int. Cl.

| | |
|---|---|
| ***F03C 4/00*** | (2006.01) |
| ***F04C 2/00*** | (2006.01) |
| ***F04C 2/107*** | (2006.01) |
| ***F04C 15/00*** | (2006.01) |

(58) Field of Classification Search
CPC ..... F04C 15/0073; F04C 15/0076; F04C 2240/50; F04C 2240/60; F16D 3/72–78; F16D 3/60; F16D 3/50
See application file for complete search history.

(56) References Cited

U.S. PATENT DOCUMENTS

| | | | | |
|---|---|---|---|---|
| 4,140,444 | A * | 2/1979 | Allen | F04C 2/1073 418/48 |
| 4,591,322 | A * | 5/1986 | Ono | F04C 2/1073 418/48 |
| 5,221,232 | A * | 6/1993 | Nameny | F16D 3/78 464/99 |
| 2010/0040498 | A1 * | 2/2010 | Akamatsu | F04C 2/1073 418/48 |
| 2012/0039734 | A1 * | 2/2012 | Sakakihara | F04C 2/1073 418/48 |
| 2014/0369875 | A1 | 12/2014 | Samad et al. | |

FOREIGN PATENT DOCUMENTS

| | | | |
|---|---|---|---|
| JP | 2014001714 | A | 1/2014 |
| KR | 1019970004921 | B1 | 4/1997 |
| KR | 100274572 | B1 | 12/2000 |
| KR | 101363038 | B1 | 2/2014 |
| KR | 1020170132661 | A | 12/2017 |

OTHER PUBLICATIONS

Japanese Office Action dated Jul. 4, 2023, in the counterpart Japanese Patent Application No. 2022-538779.

* cited by examiner

MOINEAU PUMP-TYPE QUANTITATIVE LIQUID-DISCHARGING APPARATUS

TECHNICAL FIELD

The present invention relates to a quantitative liquid-discharging apparatus used for quantitatively discharging a liquid, and more specifically, to a Moineau pump-type quantitative liquid-discharging apparatus.

BACKGROUND ART

Quantitative liquid-discharging apparatuses are used for quantitatively discharging a liquid and are widely used for molding, bonding, sealing, and material mixing in various fields such as vehicles, semiconductors, optical products, and general home appliances.

Generally, in quantitative liquid-discharging apparatuses, positive displacement pumps through which a liquid is discharged after the liquid enters are mainly used. Such positive displacement pumps may be divided into reciprocating pumps in which an actuator configured to convert a hydraulic pressure or rotational force to a linear motion operates a diaphragm or piston and rotary pumps in which a rotational force is used to operate a gear or screw. Meanwhile, since the number of cases in which a pump for quantitative discharging a liquid is operated by a physical force of an industrial robot or operator is greater than the number of cases in which a pump for quantitative discharging a liquid is fixedly installed, pumps for quantitative discharging a liquid should be smaller and lighter than general industrial pumps.

Among them, although a small reciprocating pump using one reciprocating unit has superior quantitative and repeatable properties for one-reciprocating capacity, since pulsation is generated in the small reciprocating pump, and the small reciprocating pump includes a valve for operating in one direction, the small reciprocating pump has a disadvantage for transferring a liquid containing particles or a liquid with a high viscosity.

Meanwhile, when a rotary pump is used in a quantitative liquid-discharging apparatus, a gear pump which is small, has a small pulsation, and transfers a liquid with a high viscosity using a high pressure is generally used. However, in the gear pump, since a phenomenon in which spaces of regions at which teeth are engaged when rotating expand or are compressed is used, a liquid including particles which can be jammed in the coupled gear teeth cannot be transferred, and when foreign substances are introduced thereinto, there is a high risk of damage.

As another type of rotary pump capable of being used in a quantitative liquid-discharging apparatus, there is a so-called Moineau pump or progressive cavity pump based on a "gear mechanism" known from U.S. Pat. Nos. 1,892,217 and 2,028,407 by Rent Moineau of France. In a Moineau pump, a phenomenon is used in which a stator having a hollow and molded in a screw shape having two or more threads is coupled to a rotor which is paired with the stator and has a screw shape having threads of which the number is one smaller than that of the stator so that regular spaces helically formed between the two move forward in any one direction, in which the stator is opened, according to rotation of the rotor. In the Moineau pump, since a predetermined volume is moved for a predetermined rotation angle, there is no pulsation, and thus a rotation amount of the rotor and a discharge amount can be precisely matched. In addition, since there is no point at which the volume is compressed in the pump, a liquid containing solids such as a liquid resin material in which solids and short fibers are mixed as fillers can be quantitatively discharged. In addition, since a stator of the Moineau pump is generally formed of a soft elastomeric material and maintains a state in which the stator is pressed against the rotor, the Moineau pump can quantitatively discharge a liquid even with a low viscosity or with a gas.

Meanwhile, when the rotor is coupled to the stator of the Moineau pump and rotates, since a center of a cross section of the rotor moves in a hypocycloid of an integer ratio determined by the number of threads of the screw shape of the stator, a rotation force is transmitted through power transmission parts such as a universal joint and a flex shaft allowing the movement.

Power transmission parts such as a universal joint and a flex shaft provide stable performance when there is no restriction on size, and when a small Moineau pump-type quantitative liquid-discharging apparatus is manufactured, a volume of a chamber in which the power transmission parts are disposed becomes small. Accordingly, since it is difficult to secure a torsional stiffness for precisely transmitting input rotation to a rotor, and it is sensitive to an assembly and arrangement state, there is a problem that operation and maintenance become difficult.

In addition, since a stator of a Moineau pump is a consumable part manufactured of an elastomer, the stator requires periodic replacement, in this case, a rotor is exposed in a state in which the rotor is coupled to power transmission parts such as a universal joint and a flex shaft, and thus a problem of a risk of damage to the parts due to mishandling occurs.

A stator of a Moineau pump is coupled to a rotor to form a space in which a liquid is transferred and serves to arrange an orientation of the rotor eccentrically rotating to support the rotator, and in the case of a Moineau pump for a small Moineau pump-type quantitative liquid-discharging apparatus, since a portion of an elastomer supporting the rotor is small, the stator can be easily deformed by a small force.

That is, a possibility of hysteresis damage due to fatigue mainly occurring in a small section of a slot hole of the stator supporting the rotor, that is, a section in which the elastomer is relatively thicker in the stator of which an exterior has a cylindrical shape, increases. In addition, there may be problems that leakage may occur between the stator and the rotor because the stator is not pressed against the rotor, an allowable normal operation range is reduced because of sensitivity to an operating environment, and the like.

As a way of reducing a possibility of leakage, there is a method of manufacturing a stator having a relatively small cross sectional shape. However, since the method causes an increase in friction, a lifetime of the stator is reduced, and the performance of the stator is degraded. Alternatively, as proposed in Korean Patent No. 10-0274572, there is a method of manufacturing a stator having an elastomer with a uniform thickness to assist an inner elastomer. However, there is a problem that a structure according to the method is difficult to manufacture in a small size.

RELATED ART

Patent Document (Patent Document 1) U.S. Pat. No. 1,892,217
(Patent Document 2) U.S. Pat. No. 2,028,407
(Patent Document 3) Korean Patent No. 10-0274572

Technical Problem

The present invention is directed to providing a Moineau pump-type quantitative liquid-discharging apparatus in which a rotor of a main shaft rotates while matching a slot hole in a stator to minimize fatigue and wear of the stator.

The present invention is also directed to providing a Moineau pump-type quantitative liquid-discharging apparatus which is advantageous for quantitative discharging of a liquid by allowing a rotation angle input from a driving unit to be precisely transmitted to a rotor.

Technical Solution

To achieve the above-mentioned object, an embodiment of the present invention provides a Moineau pump-type quantitative liquid-discharging apparatus including a stator in which a slot hole is formed, a main shaft including a first shaft part and a second shaft part, which are eccentric with respect to each other, and a rotor which extends from the first shaft part and is inserted into the slot hole, first and second slide bearings to which the first shaft part and the second shaft part are rotatably coupled, respectively, and first and second sliders which guide the first and second slide bearings to move in directions to cross each other. In this case, the slot hole is defined as a space which is coupled to the rotor and through which a liquid is transferred. In addition, the movement directions of the first and second slide bearings are perpendicular to an extension direction of the rotor.

The first slider includes a first movement groove into which the first slide bearing is inserted and by which movement of the first slide bearing is guided and the second slider includes a second movement groove into which the second slide bearing is inserted and by which movement of the second slide bearing is guided.

The first and second movement grooves may extend perpendicular to each other.

The first and second movement grooves may be formed at side surfaces of the first slider and the second slider facing each other, respectively, and the first slider may include, in a side which is opposite to the side surface at which the first movement groove is formed, a chamber which guides a liquid to a space between the rotor and the slot hole and a supply part through which the liquid is supplied to the chamber.

When the first slider and the second slider are assembled, a sum of heights of the first and second movement grooves may correspond to a sum of heights of the first and second slide bearings. Accordingly, first and second slide bearing may not move in an axial direction of the main shaft.

The main shaft may be fixed to any one of the first and second slider bearings in the axial direction to not move in the axial direction. Accordingly, the main shaft may perform linear movement along an extended direction of the slot hole while rotating in the slot hole.

The first and second shaft parts may include first and second rotary shaft parts rotatably coupled to first and second bearing holes of the first and second slide bearings, respectively, the first rotary shaft part may include an annular protruding part protruding in a radial direction, and the first bearing hole may be formed to be stepped such that the protruding part is inserted into the first bearing hole and fixed in the axial direction. Accordingly, the main shaft may be fixed in the axial direction, and thus, rotate without moving in the axial direction.

The slot hole may be formed to extend as a twin helices hole having two row of screw thread, and the rotor is formed to have one screw thread in which a lead of the rotor is half a lead of the twin helices hole. In addition, in the main shaft, a center of the first rotary shaft part rotatably supported by the first slide bearing of the first shaft part may be formed to match a center of any one arbitrary cross section in the axial direction of the rotor, and a center of the second rotary shaft part rotatably supported by the second slide bearing of the second shaft part may be formed to match a center of a cross section in the axial direction which is spaced L/2 (L: a lead of the screw thread of the rotor) from the any one arbitrary cross section in the axial direction.

The first and second movement grooves may be formed to respectively allow the first and second slide bearings to each move at least an eccentric distance between centers of the first and second shaft parts of the main shaft from a central position of movement in both movement directions.

The stator may be fixedly inserted into a stator housing to be integral with the stator housing, and the stator housing is coupled to the first slider to be replaceable.

The second shaft part of the main shaft may include a coupling connection part on an opposite end to the rotor and a coupling part which is connected to the coupling connection part is provided to transmit rotation input from a driving unit while allowing eccentricity. In this case, the coupling part may include a first coupling hub, a second coupling hub, and a coupling disc disposed between the first coupling hub and the second coupling hub. First and second coupling protruding parts may be formed on side surfaces of the first and second coupling hubs which face each other, respectively. First and second coupling grooves, into which the first and second coupling protruding parts are inserted and by which movements of the first and second coupling protruding parts are guided, respectively, may be formed at both side surfaces of the coupling disc. The first and second coupling grooves may be formed to extend perpendicular to each other. The Moineau pump-type quantitative liquid-discharging apparatus may further include a coupling housing accommodating the coupling part therein.

Advantageous Effects

According to embodiments, it is ensured that a rotor is moved to a position at which the rotor matches a slot hole of a stator while the rotor rotates due to movement of a main shaft having eccentricity. Slide bearings coupled to the main shaft and sliders to which the slide bearings are coupled guide such movement of the main shaft. In a known Moineau pump, since movement of a rotor is restricted by a stator, there is a high possibility of wear and fatigue damage of the stator. However, according to the present invention, since the slot hole is formed to match the rotor, and matching rotation of the rotor is guided by the movement of the main shaft, wear and fatigue damage of the state is minimized when compared to the known Moineau pump. In addition, since the rotor is moved to the position at which the rotor matches the slot hole regardless of an operating environment such as a viscosity or operation pressure of a liquid, the rotor may operate in a wider operating environment. Accordingly, since a pressure applied to an inner wall of the slot hole of the stator is minimized, precision of quantitative discharging of the liquid can be further improved, and wear of the stator can also be prevented.

In the quantitative liquid-discharging apparatus according to the present invention, since it is ensured that a stator housing, a first slider, a second slider, and a coupling housing are assembled at matching positions, and the stator housing integrated with the stator can be easily replaced, there are advantages of easy replacement of the stator, which is a consumable, and easy maintenance and repair of the quantitative liquid-discharging apparatus.

MODES OF THE INVENTION

Hereinafter, specific content for implementing the present invention will be described with reference to the accompanying drawings. In addition, in description of the present invention, when it is determined that detailed description of related well-known functions which are clear to those skilled in the art may unnecessarily obscure the gist of the present invention, such detailed description will be omitted.

The terminology used herein to describe embodiments of the present invention is not intended to limit the scope of the present invention. The singular forms are intended to include the plural forms, unless the context clearly indicates otherwise, and components present in a distributed manner may be present in a combined component unless there is a special limitation. It should be further understood that the terms "comprise," "comprising," "include," and/or "including," when used herein, specify the presence of stated features, numbers, steps, operations, elements, components, or combinations thereof, but do not preclude the presence or addition of one or more other features, numbers, steps, operations, elements, components, or combinations thereof.

In addition, although the terms "first," "second," and the like may be used herein to describe various components, these components should not be limited by these terms. These terms are only used to distinguish one component from another component. For example, a second component could be termed a first component, and a first component could similarly be termed a second component without departing from the scope of the present invention.

Figure 1:
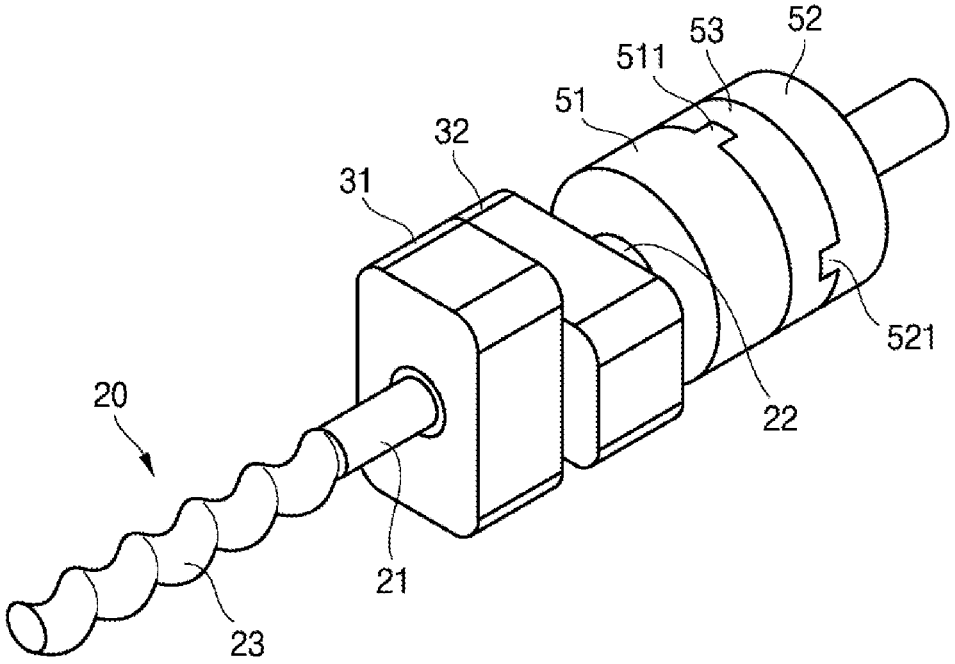
FIG. 1 is a schematic perspective view illustrating an internal configuration of a Moineau pump-type quantitative liquid-discharging apparatus according to an embodiment of the present invention.
Figure 2:
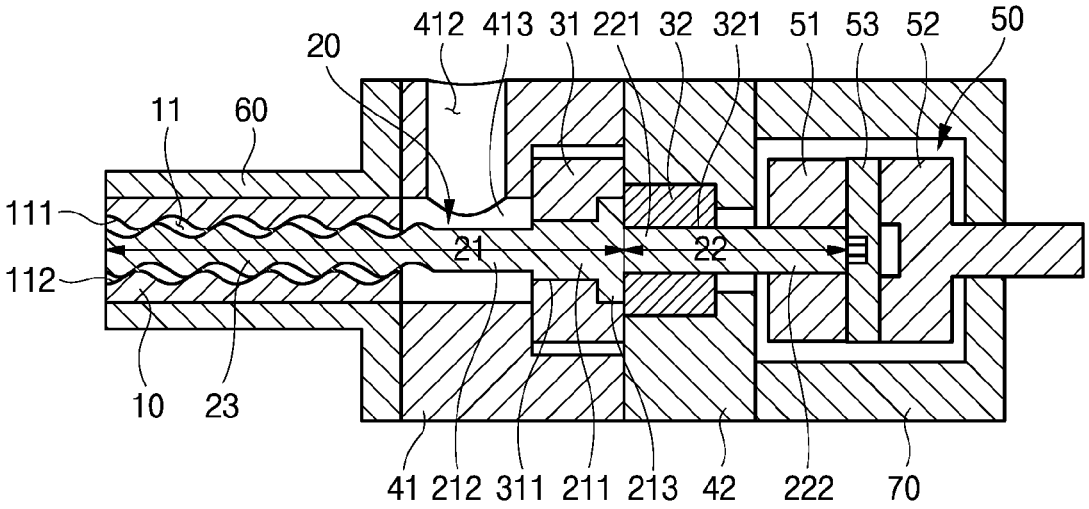
FIG. 2 is a cross-sectional view schematically illustrating the internal configuration of the Moineau pump-type quantitative liquid-discharging apparatus of FIG. 1.

FIG. 1 is a schematic perspective view illustrating an internal configuration of a Moineau pump-type quantitative liquid-discharging apparatus according to an embodiment of the present invention. In addition, FIG. 2 is a cross-sectional view schematically illustrating the internal configuration of the Moineau pump-type quantitative liquid-discharging apparatus of FIG. 1. In addition, FIG. 3 is an exploded view illustrating a state in which the Moineau pump-type quantitative liquid-discharging apparatus of FIG. 2 is dissembled.

Figure 3:
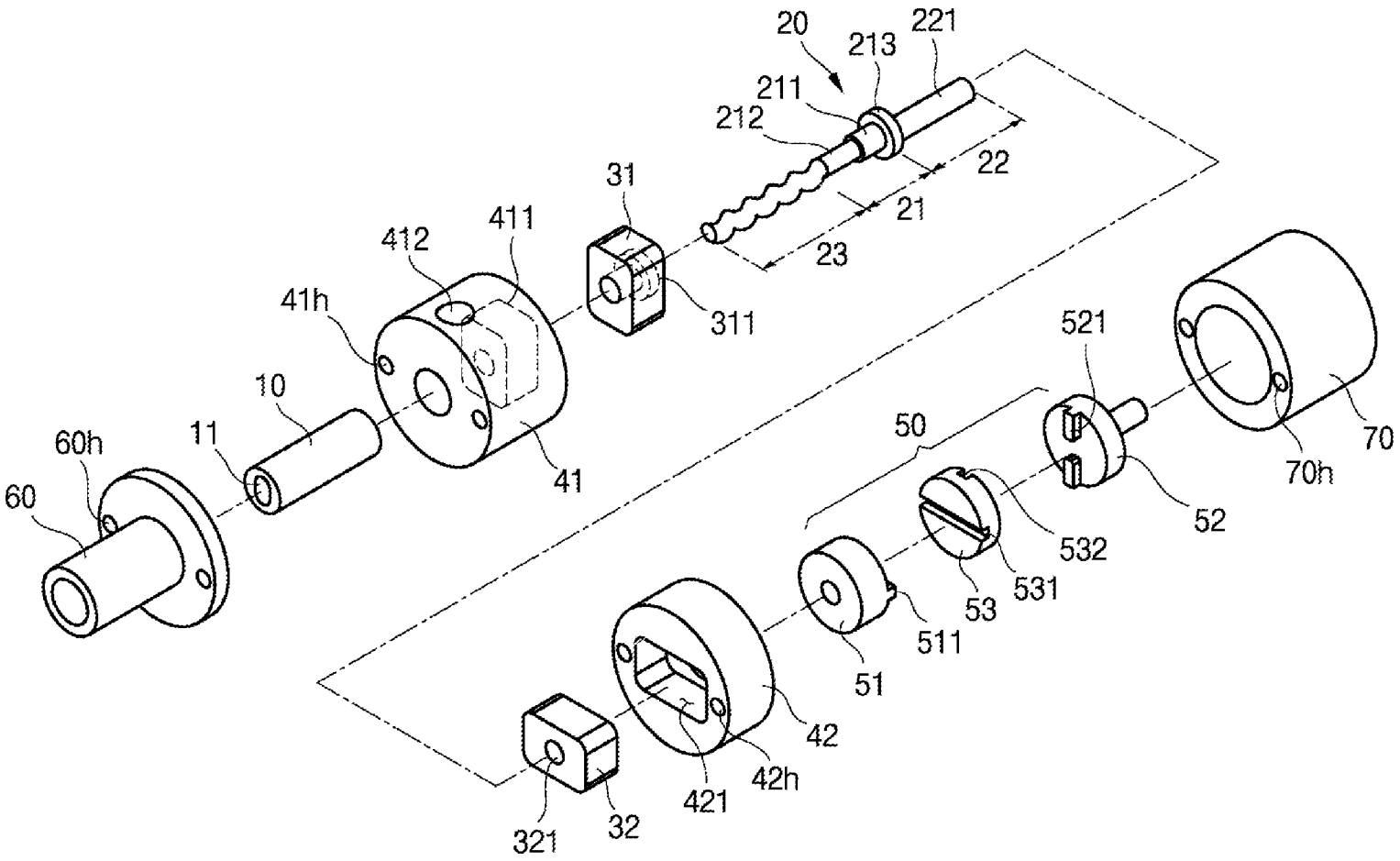
FIG. 3 is an exploded view illustrating a state in which the Moineau pump-type quantitative liquid-discharging apparatus of FIG. 2 is dissembled.

Referring to FIGS. 1 to 3, the Moineau pump-type quantitative liquid-discharging apparatus according to the embodiment of the present invention includes a stator 10, a main shaft 20, first and second slide bearings 31 and 32, and first and second sliders 41 and 42.

A slot hole 11 formed to pass through an inner portion of the stator 10 in an extension direction of the stator 10 is formed in the stator 10. According to the embodiment of the present invention, the slot hole 11 may be formed as a twin helices hole which has a shape of two rows of screw. One side inner wall 111 having a semicircular shape and the other side inner wall 112 having a semicircular shape are formed at both ends of the slot hole 11, and the slot hole 11 has a cross section having a slot shape in which a distance between both ends extends. According to the embodiment of the present invention, an end at a discharge hole side of the slot hole 11 extends toward a first movement groove 411 of the first slider 41. Since the slot hole 11 extends in a shape having the two rows of screw thread, a cross section of the stator 10 in the extension direction is formed in a ripple shape.

A rotor 23 of the main shaft 20 is inserted into the slot hole 11. The rotor 23 corresponding to the slot hole 11 is a helical rotor having one screw thread, and a lead of the screw thread of the rotor 23 is formed to be half of a lead of a screw thread of the slot hole 11. Semicircles formed on the inner walls 111 and 112 of the slot hole 11 may correspond to semicircles of a circle defined by a cross section of the rotor 23. According to the embodiment of the present invention, a distance between centers of the semicircles of both ends of the slot hole 11 may correspond to a distance between centers of first and second shaft parts 21 and 22 of the main shaft 20, that is, twice an eccentric distance.

The slot hole 11 is defined as a movement space of the rotor 23 and a discharge space of a liquid according to the movement. The rotor 23 rotates in the slot hole 11 and straightly reciprocates along the slot hole 11, and thus the liquid is sequentially transferred and discharged through the slot hole 11.

The stator 10 may be manufactured of a synthetic resin such as an elastomer having elasticity.

According to the embodiment of the present invention, the stator 10 may be disposed in the stator housing 60 or fixedly attached to or molded in the stator housing 60. When the stator 10 is replaced due to wear and the like of the stator 10, the stator 10 may be integrally detached with the stator housing 60 and replaced. According to the embodiment of the present invention, the stator 10 is integrally formed with the stator housing 60 to form a single part and detachably fixed to the first slider 41.

According to the embodiment of the present invention, the main shaft 20 includes the first shaft part 21 and the second shaft part 22 which are eccentric with respect to each other, and the rotor 23.

The rotor 23 is provided at one side of the first shaft part 21 in an axial direction, and the second shaft part 22 eccentric with respect to the first shaft part 21 is formed at a side opposite to the first shaft part 21 in the axial direction. The first and second shaft parts 21 and 22 respectively include rotary shaft parts 211 and 221 rotatably coupled to first and second bearing holes 311 and 321 of the first and second slide bearings 31 and 32.

The first shaft part 21 includes an extension part 212 between the rotary shaft part 211 and the rotor 23. The extension part 212 is positioned in a chamber 413 of the first slider 41. A protruding part 213 having a ring shape and protruding in a radial direction is formed on the rotary shaft part 211 of the first shaft part 21. The protruding part 213 is formed to prevent movement of the main shaft 20 in the axial direction, and a position thereof is not limited to the embodiment illustrated in the drawings. For example, the protruding part 213 may be formed on the rotary shaft part 221 of the second shaft part 22.

The second shaft part 22 extends from the first shaft part 21 in a direction opposite to the rotor 23, and a coupling connection part 222 coupled to a coupling part 50 and configured to receive a rotational force of a driving unit is provided on an end portion of the second shaft part 22.

The rotor 23 extends from one side of the first shaft part 21 in the axial direction and is inserted into the slot hole 11 as described above.

The main shaft 20 may receive a rotational force from the driving unit (not shown) configured to transmit a rotational force. The coupling part 50 transfers the rotational force, that is, a rotation angle, received from the driving unit to the main shaft 20 through the coupling connection part 222. Coupling which allows the coupling part 50 to be eccentric and an input shaft and an output shaft to be connected so that speeds thereof are the same may be used. As examples of the coupling, there are Oldham coupling, Schmidt coupling, and the like, and the coupling part 50 according to the embodiment of the present invention will be described in more detail with reference to FIGS. 5 and 6.

The Moineau pump-type quantitative liquid-discharging apparatus according to the embodiment of the present invention includes the first slide bearing 31 rotatably coupled to the first shaft part 21 of the main shaft 20 and the second slide bearing 32 rotatably coupled to the second shaft part 22.

More specifically, the first bearing hole 311 is formed in the first slide bearing 31, and here, the first rotary shaft part 211 of the first shaft part 21 is rotatably coupled. In addition, the second bearing hole 321 is formed in the second slide bearing 32, and here, the second rotary shaft part 221 of the second shaft part 22 is coupled. In this case, the first and second bearing holes 311 and 321 may be positioned at central portions of the slide bearings. In addition, the first bearing hole 311 may be formed to be stepped to accommodate the protruding part 213.

The first and second slide bearings 31 and 32 are respectively positioned in the first and second movement grooves 411 and 421 of the first and second sliders 41 and 42 and slidably move along the first and second movement grooves 411 and 421.

According to the embodiment of the present invention, the first and second sliders 41 and 42 are coupled so that the first and second movement grooves 411 and 421 face each other, and the first and second movement grooves are connected to form one space. Accordingly, the first and second slide bearings 31 and 32 may face and come into contact with each other and slidably move. At least one pair of facing sidewalls of the first and second slide bearings 31 and 32 may be slide bearings formed of low friction materials and having surfaces parallel to each other.

According to the embodiment of the present invention, the first and second sliders 41 and 42 respectively include the first and second movement grooves 411 and 421, and the first and second movement grooves 411 and 421 serve as rails configured to guide straight sliding movement of the first and second slide bearings 31 and 32. The first and second sliders 41 and 42 are coupled to slightly come into contact with two parallel side surfaces of the first and second slide bearings 31 and 32.

According to the embodiment of the present invention, the first movement groove 411 and the second movement groove 421 may extend in directions perpendicular to an extension direction of the main shaft 20, and the first movement groove 411 and the second movement groove 421 may extend to be perpendicular to each other. An extension direction of the movement groove is defined as a direction in which the slide bearing moves in the movement groove. Accordingly, the first slide bearing 31 may straightly move along a first movement axis perpendicular to the extension direction of the main shaft 20, and the second slide bearing 32 may straightly move along a second movement axis perpendicular to the extension direction of the main shaft 20 and perpendicular to the first movement axis. Accordingly, the first movement axis and the second movement axis may be perpendicularly arranged. According to the embodiment of the present invention, the first movement groove 411 and the second movement groove 421 are not limited to the perpendicular arrangement. That is, the first movement groove 411 and the second movement groove 421 may be arranged to intersect each other in a state in which the first movement groove 411 and the second movement groove 421 are not perpendicular to each other. However, the perpendicular arrangement may allow loads applied to the first and second slide bearings 31 and 32 to be uniform and the quantitative liquid-discharging apparatus to be easily manufactured.

The first and second movement grooves 411 and 421 are formed in facing side surfaces of the first and second sliders 41 and 42. Accordingly, when the first and second sliders 41 and 42 are assembled, the first and second movement grooves 411 and 421 may be connected to form one space. In this case, a total sum of heights of the first and second movement grooves 411 and 421 may be the same as a total sum of heights of the first and second slide bearings 31 and 32 in a state in which the first and second slide bearings 31 and 32 are assembled. That is, in the state in which the first and second slide bearings 31 and 32 are continuously assembled in a direction toward the main shaft 20, when the first and second slide bearings 31 and 32 are accommodated in the movement grooves 411 and 421 of the first and second sliders 41 and 42, the first and second slide bearings 31 and 32 may be coupled such that the first and second slide bearings 31 and 32 do not move in the axial direction and do move along the first and second movement grooves 411 and 421.

As shown in FIG. 2, a supply hole 412 through which a liquid to be discharged through the slot hole 11 toward the rotor 23 enters is formed in the first slider 41, and the supply hole 412 is connected to the chamber 413 of the first slider 41. The liquid introduced into the chamber 413 is guided to the slot hole 11 due to movement of the rotor 23.

In addition, a bottom surface of the first slide bearing 31 facing the chamber 413 of the first slider 41 may be formed to block the chamber 413 regardless of a movement state of the first slide bearing. A passage between the first movement groove 411 of the first slider 41 and the chamber 413 is sealed by the bottom surface of the first slide bearing 31 such that a fluid does not pass, and only the first shaft part 21 extends. In a state in which the first bearing hole 311 is sealed with respect to the first shaft part 21, the chamber 413 may allow a pressure generated by the rotor 23 and the stator 10 to be transmitted to the supply hole 412.

In addition, as shown in FIG. 3, according to the embodiment of the present invention, the first and second sliders 41 and 42 may include coupling holes connected to each other so that the movement grooves 411 and 421 are assembled to always have a predetermined angle therebetween. In FIG. 3, coupling holes 42*h* formed in the second slider 42 are illustrated, and corresponding coupling holes (not shown) are formed in a corresponding surface of the first slider 41 so that assembly is ensured with a predetermined angle using connection shafts (not shown) and the like.

In addition, coupling holes 41*h* which ensure that the stator housing 60 is assembled at a predetermined angle are formed in the first slider 41. Matching between the slot hole 11 and the rotor 23 can be ensured by assembling the first slider 41 and the stator housing 60 so that the coupling holes 41*h* match coupling holes 60*h* formed in a flange of the stator housing 60. Accordingly, a position at which the rotor 23 and the stator 10 match each other may be fixedly repeatedly reproduced.

Figure 4B:
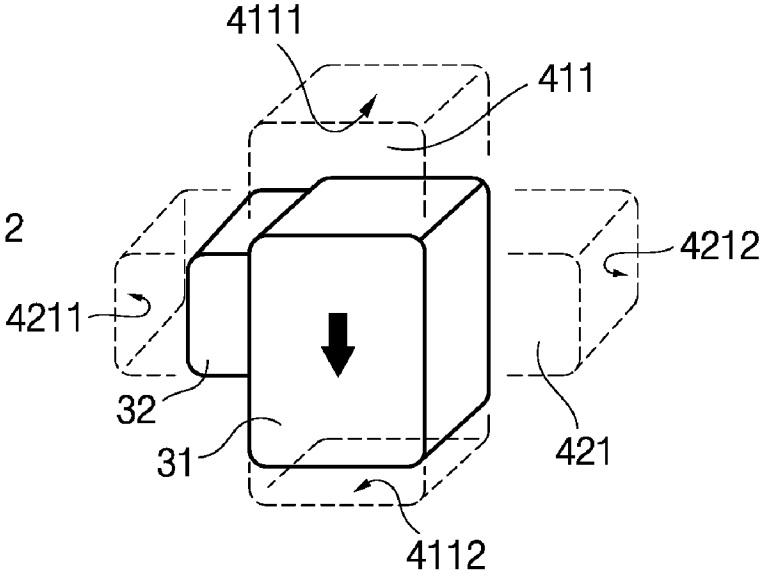
FIG. 4A and FIG. 4B are perspective views illustrating a process in which first and second slide bearings move to intersect along first and second movement grooves within predetermined ranges in accordance with rotation of a main shaft, in the Moineau pump-type quantitative liquid-discharging apparatus of FIG. 1.
Figure 4A:
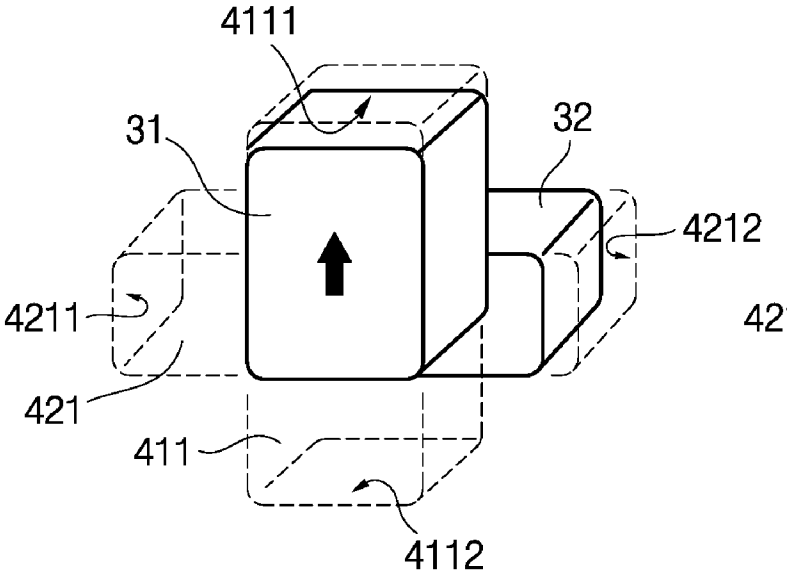
Figure 5:
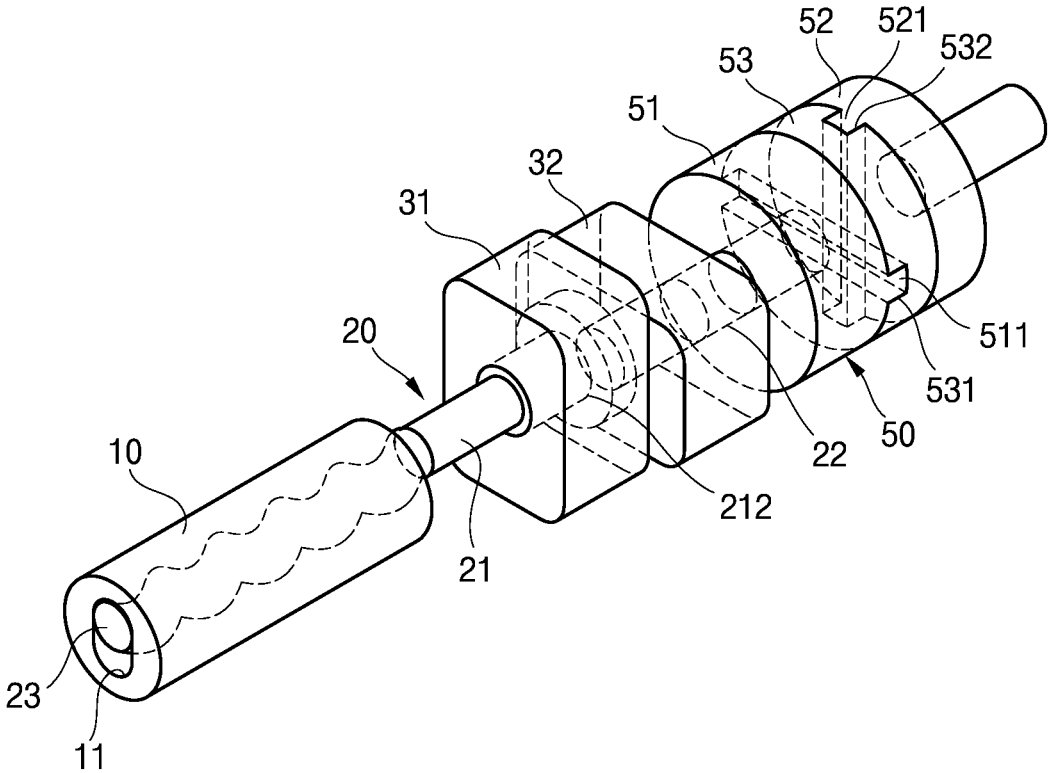
FIGS. 5 and 6 are perspective views illustrating operation of the Moineau pump-type quantitative liquid-discharging apparatus of FIG. 1 according to rotation of the main shaft.
Figure 6:
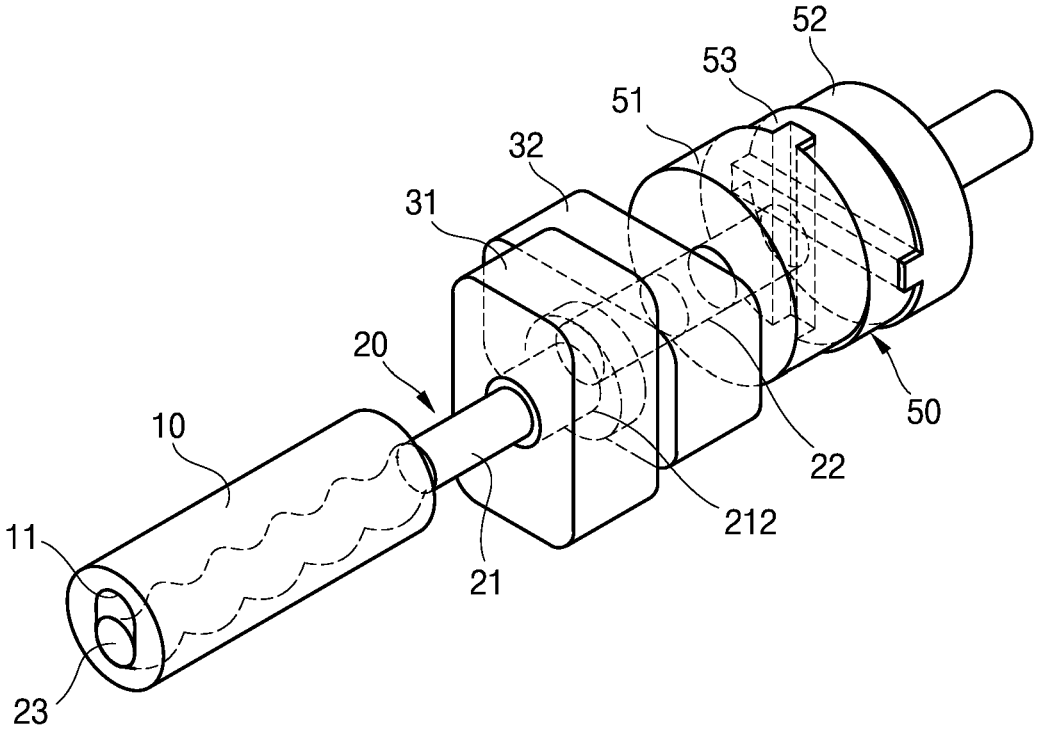

FIG. 4A and FIG. 4B are schematic views for describing movement of the first and second slide bearings according to rotation of the main shaft in the Moineau pump-type quantitative liquid-discharging apparatus according to the embodiment of the present invention. In addition, FIGS. 5 and 6 show displacements of the rotor 23 in the slot hole 11 of the stator 10 according to the movement of the first and second slide bearings according to rotation of the main shaft.

As shown in FIG. 4A and FIG. 4B, the first slide bearing 31 and the second slide bearing 32 reciprocate to perpendicularly intersect each other according to rotation of the main shaft 20.

In the first and second movement grooves 411 and 421, the first and second slide bearings 31 and 32 straightly reciprocate between one side inner walls 4111 and 4211 and the other side inner walls 4112 and 4212 in longitudinal directions of the first and second movement grooves 411 and 421.

According to the embodiment of the present invention, the one side inner walls 4111 and 4211 and the other side inner walls 4112 and 4212 of the first and second movement grooves 411 and 421 are positioned apart from each other so that the rotor 23 alternately matches one side inner wall 111 and the other side inner wall 112 in the slot hole 11 of the stator 10 according to rotation of the main shaft 20. That is, the one side inner walls 4111 and 4211 and the other side inner walls 4112 and 4212 of the first and second movement grooves 411 and 421 are formed to have lengths so that the first and second slide bearings 31 and 32 are allowed to each move at least an eccentric distance of the main shaft 20 from central positions toward the inner walls. The eccentric distance of main shaft 20 is a distance between a center of the first rotary shaft part 211 of the first shaft part 21 and a center of the second rotary shaft part 221 of the second shaft part 22.

As shown in FIGS. 5 and 6, according to the movement of the first and second slide bearings 31 and 32, the rotor 23 rotates and moves between one side inner wall and the other side inner wall of the slot hole 11 of the stator 10, and a change in phase according to rotation of the rotor 23 and a central position of the cross section of the rotor 23 in the slot hole 11 follows sine curves.

Referring to FIGS. 7 to 10, movement of the rotor 23 in the slot hole 11 of the stator 10 according to the embodiment of the present invention will be described in more detail.

FIGS. 7A to 7G are, respectively, a view illustrating a state in which the rotor 23 is arranged in the slot hole 11 of the stator 10 when a cross section is seen in the axial direction in a state in which the stator 10 and the rotor 23 are coupled. FIGS. 7A to 7G are views illustrating a change from a state in which a center of the rotor 23 is positioned at a central position of the slot hole 11 and the rotor 23 is at a phase of 0° to a state in which the rotor 23 is positioned at the central position of the slot hole 11 again and is at a phase of 180°. In FIGS. 7A to 7G, a line in the rotor 23 in the radial direction is illustrated for describing the phase of the rotor 23 for reference.

Figures 7A, 7B, 7C, 7D, 7E, 7F, 7G:
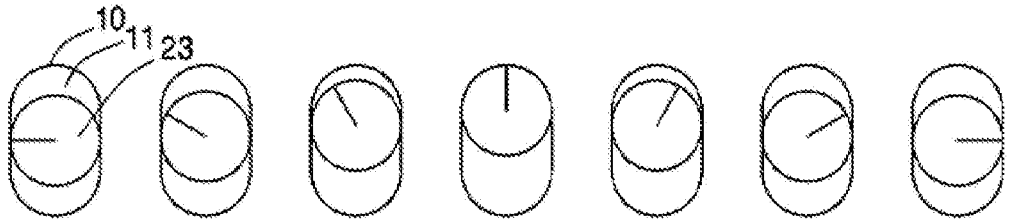
FIGS. 7A to 7G are a set of schematic views illustrating a trajectory of a center of a rotor seen on a cross section in an axial direction when a stator and the rotor of the Moineau pump according to the embodiment of the present invention match each other and rotate.

As in FIG. 7D, when a phase in a state in which the cross section of the rotor 23 is arranged at one side end of the slot hole 11 of the stator 10 is defined as 90°, a phase in a state in which the cross section of the rotor 23 is arranged at the other side end of the slot hole 11 corresponds to 270°. That is, the rotor 23 is arranged at a position obtained by multiplying a sine value of a phase by a distance from a central position of the slot hole 11 of the stator 10 to a central point of an arc (semicircle) at one side of the slot hole 11. Meanwhile, a change in the arrangement state according to the phase between the stator 10 and the rotor 23 is continuously formed along a cross section in the axial direction in the state in which the stator 10 and the rotor 23 are fixed. That is, when it is assumed and observed that the rotor 23 is coupled and moves in 1 mm increments on the cross section of the stator of which a lead of the screw thread is 12 mm, each cross section thereof is in a state in which a slot hole 11 of the stator 10 rotates 30° from a previous state based on a central point and a phase of the cross section of the rotor also rotates 30° from a previous phase at the same time. In this case, when the rotor moves 6 mm, since the cross section thereof is in a state in which a slot hole 11' of the stator 10 rotates 180° and a phase of the rotor 23 rotates 180° at the same time, the cross section of the rotor 23 at this point is the same as the cross section of the rotor 23 at a starting position, in other words, is in a state in which a shape of the screw thread of the rotor 23 rotates one time. That is, as described above, a lead of the rotor 23 is formed to have half the lead of the screw thread formed in the slot hole 11 of the stator 10. According to the sequential change in the cross section, the rotor 23 uniformly separates the slot hole 11 to form a state to allow a liquid to be transferred, the rotor 23 is rotatable in the slot hole 11, and a space divided according to rotation can be uniformly moved.

Figure 8:
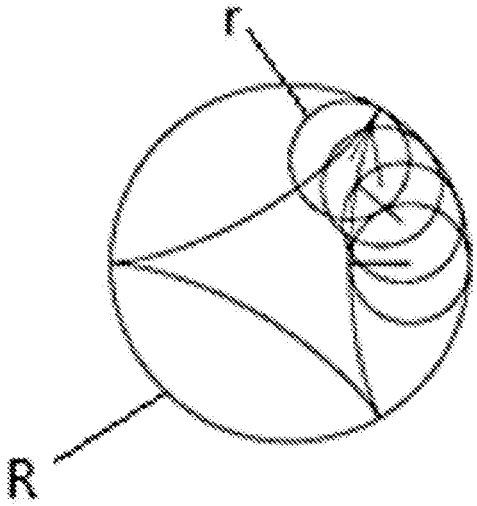
FIG. 8 is a view for describing a trajectory of a center of a rotor when the rotor matches a slot hole of a stator in a Moineau pump and rotates.

FIG. 8 is a view illustrating a deltoid for describing a trajectory of a center of a rotor when the rotor matches a slot hole of a stator in a Moineau pump and rotates. The trajectory of the center of the rotor seen on a cross section in an axial direction follows a hypocycloidal trajectory. When there are a large circle R and a small circle r, a hypocycloidal trajectory is defined as a trajectory drawn by one fixed point of the small circle r when the small circle r rolls in the large circle R. A shape of the trajectory is determined by a value k obtained by dividing a radius of the large circle R by a radius of the small circle r. For example, when a value k is 3, a deltoid trajectory having three sharp points is obtained, and when a value k is 2, a straight trajectory having two sharp points and a length the same as a radius of a large circle R is obtained. In this case, when the stator slot hole and the rotor match each other, a value k of a hypocycloidal trajectory followed by the center of the rotor is the same as the number of the screw thread formed in the slot hole of the stator. That is, when the slot hole of the stator has two rows of screw thread, a trajectory along which the rotor matches the stator is a straight line corresponding to a value k of 2, and when the slot hole of the stator has three rows of screw thread, a trajectory along which the rotor matches the stator becomes a deltoid corresponding to a value k of 3.

Figure 9:
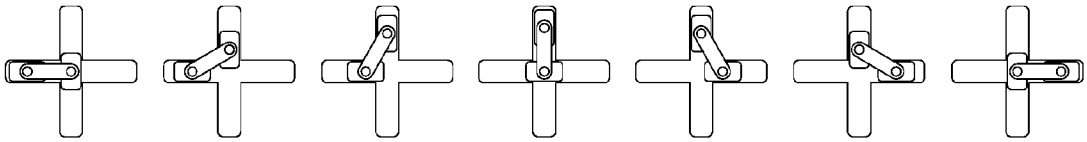
FIGS. 9 and 10 are views illustrating an example of movement of a trammel of Archimedes performed by two rails perpendicularly crossing each other, slide bearings capable of moving on the rails, and a connection rod which has a fixed length, connects the slide bearings, and is attached to rotational shafts.
Figure 10:
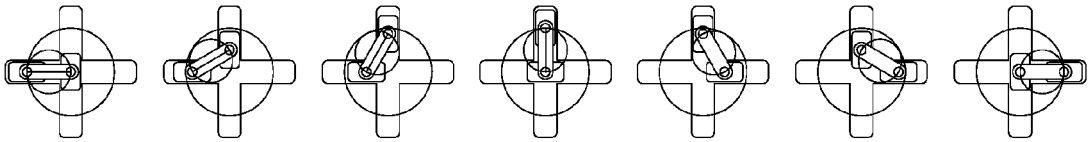

FIGS. 9 and 10 are views for describing a movement principle of the first and second slide bearings of the Moineau pump-type quantitative liquid-discharging apparatus according to the embodiment of the present invention. FIGS. 9 and 10 illustrate examples of movement of a trammel of Archimedes performed by two rails perpendicularly crossing each other, slide bearings capable of moving on the rails, and a connection rod which has a fixed length, connects the slide bearings, and is attached to rotational shafts.

Referring to FIGS. 9 and 10, although movement of a trammel of Archimedes is generally applied to an apparatus configured to form an oval, as shown in FIG. 10, the movement of the trammel of Archimedes may also be applied to an apparatus configured to form a hypocycloid in which a distance between centers of the rotational shafts connecting slide bearings corresponds to a distance r and a value k is 2. That is, this means that an apparatus that moves like the movement of the trammel of Archimedes may serve as an apparatus configured to move a stator of a Moineau pump, in which the stator has two rows of screw thread, and a rotor to match each other according to rotation of an input shaft.

The Moineau pump-type quantitative liquid-discharging apparatus according to the present invention is an apparatus allowing the rotor 23 to perform hypocycloidal movement with a value k of 2 using the first and second slide bearings 31 and 32, the first and second sliders 41 and 42 which guide straight movement of the bearings, and the main shaft 20 including the first shaft part 21 and the second shaft part 22 which are eccentric with respect to each other.

According to the embodiment of the present invention, in any one cross section in the axial direction in the state in which the rotor 23 and the stator 10 are coupled, when a longitudinal direction of the slot hole 11 is the same as an extension direction of the first movement groove 411, a center of the cross section of the rotor 23 at the corresponding cross section thereof may be formed to match or be adjacent to the center of the first shaft part 21. In this case, in another cross section, in which a longitudinal direction of the slot hole 11 is the same as an extension direction of the second movement groove 421, in the axial direction, the center of the cross section of the rotor 23 may be formed to match or be adjacent to the center of the second shaft part 22. In this case, the rotor 23 attached to the main shaft 20 performs movement which is the same as a trammel of Archimedes performed by a large circle R of which a diameter is the same as a distance between two sides of the slot hole on the cross section of the stator in the axial direction and a small circle r of which a diameter corresponds to ½ of the distance between the two sides of the slot hole and thus becomes an apparatus configured to move and match the rotor 23 and the stator 10.

According to the embodiment of the present invention, when the extension directions of the first and second movement grooves 411 and 421 are perpendicular to each other, and in one cross section, in which the longitudinal direction of the slot hole 11 matches the extension direction of the first movement groove 411, in the axial direction, when the center of the cross section of the rotor 23 is formed to match or be adjacent to the center of the first shaft part 21, in another cross section, which is spaced apart from the above described cross section and a longitudinal direction of the slot hole 11 rotates 90°, in the axial direction, the center of the cross section of the rotor 23 and the center of the second shaft part 22 may be formed to match or be adjacent to each other. In this case, when a lead of the rotor 23 is L, a distance between the above-described one cross section and another axial direction may be 2/L. Meanwhile, when the above-described principle is used, even when the extension directions of the first movement groove 411 and the second movement groove 421 are not perpendicular, the same movement trajectory can be obtained.

Referring to FIGS. 5 and 6, in a result of the movement, the rotor 23 may be moved and fixed to maintain a state in which the rotor 23 always completely matches the stator 10 that is fixed to allow a phase to be arranged at an input rotation angle. In the first and second movement grooves 411 and 421, the first and second slide bearings 31 and 32 are formed to be movable at least a separation distance between the center of the first shaft part 21 and the center of the second shaft part 22 in two directions from central positions.

In the rotor 23, since the protruding part 213 of the first shaft part 21 is coupled to a stepped portion of the first bearing hole 311 of the first slide bearing 31, movement of the main shaft 20 in the axial direction is prevented, and thus a matching state can be maintained.

The coupling part 50 will be described with reference to FIGS. 1 to 6. In the Moineau pump-type quantitative liquid-discharging apparatus according to the embodiment of the present invention, the main shaft 20 is connected to the driving unit through the coupling part 50.

Since the first and second shaft parts 21 and 22 of the main shaft 20 are eccentric with respect to each other, the first and second shaft parts 21 and 22 rotate about different axial centers. The coupling part 50 serves to effectively transmit rotation of a shaft transmitted from the driving unit as rotational movement performed by the rotor of which an axial center is changed.

The coupling part 50 includes a first coupling hub 51, a second coupling hub 52, and a coupling disc 53 disposed between the first coupling hub 51 and the second coupling hub 52.

The first coupling hub 51 is coupled to the main shaft 20. The coupling connection part 222 of the main shaft 20 is coupled to a center of the first coupling hub 51 and rotates therewith. The second coupling hub 52 is coupled to the driving unit at an opposite side.

First and second coupling protruding parts 511 and 521 are formed on side surfaces of the first and second coupling hubs 51 and 52 facing each other. The first and second coupling protruding parts 511 and 521 may extend on the facing side surfaces of the first and second coupling hubs 51 and 52 to pass through centers of the side surfaces along diameters thereof and be formed on parts or entireties of the side surfaces. The first and second coupling protruding parts 511 and 521 extend to be perpendicular to each other. The first coupling protruding part 511 may extend parallel to the extension direction of the second movement groove 421, and the second coupling protruding part 521 may extend parallel to the first movement groove 411.

First and second coupling grooves 531 and 532, which guide sliding movement of the first and second coupling protruding parts 511 and 521, are formed in two side surfaces of the coupling disc 53 to pass through a center of the coupling disc 53 in a diameter direction. Accordingly, the first and second coupling protruding parts 511 and 521 may be respectively inserted into the first and second coupling grooves 531 and 532 and move in extension directions thereof. Since the first and second coupling grooves 531 and 532 respectively correspond to the first and second coupling protruding parts 511 and 521, the first and second coupling grooves 531 and 532 extend to be perpendicular to each other. Since two side ends of the first and second coupling grooves 531 and 532 are open, the first and second coupling protruding parts 511 and 521 are allowed to move outward beyond circumferential boundaries of the first and second coupling grooves 531 and 532.

The coupling part 50 is disposed in the coupling housing 70, and the coupling housing 70 is coupled to the second slider 42. Coupling holes 70*h* for assembly are formed in the coupling housing 70.

According to the embodiment of the present invention, the stator housing 60, the first slider 41, the second slider 42, and the coupling housing 70 include coupling holes 60*h*, 41*h*, 42*h*, and 70*h* which match each other and are integrally fixed by fixing members. Accordingly, the stator housing 60, the first slider 41, the second slider 42, and the coupling housing 70 can be simply fixed to match each other.

Through this stricture, the coupling part 50 allows eccentricity and transmits the same speed of the input shaft and the output shaft.

A Moineau pump-type quantitative liquid-discharging apparatus according to another embodiment of the present invention is not limited to the coupling part 50 illustrated in FIGS. 1 to 6, and other components which transmit rotation of a driving unit to allow eccentric rotation may be used in the Moineau pump-type quantitative liquid-discharging apparatus according to another embodiment of the present invention. However, in the coupling part 50 according to the embodiment of the present invention, a space is minimized, and eccentric rotation of the main shaft 20 is allowed.

As described above, in the Moineau pump-type quantitative liquid-discharging apparatus according to the embodiment of the present invention, since the rotor 23 attached to the main shaft 20 moves to a position at which the rotor 23 matches the stator while rotating, there is an advantage in that an additional load for determining a position of the rotor is not applied to the elastomer of the stator. Accordingly, particularly in a small pump, since an elastomer of a stator is allowed to be manufactured to apply a smaller pressure to a rotor, damage to a surface of a slot hole of the stator can be minimized. In addition, the rotor more uniformly presses the stator, and fatigue of the elastomer of the stator can be reduced. In addition, since the rotor moves and matches the stator regardless of an operating environment such as a viscosity or operation pressure of a liquid, the rotor can operate in a wider operating environment.

In addition, according to the present invention, since the rotor 23 is formed in a state in which the rotor 23 is fixed to the main shaft 20, and a wide area of the main shaft 20 is supported by the first and second slide bearings 31 and 32 and the first and second sliders 41 and 42, even when the stator is separated for checking, cleaning, or replacing, vulnerable moving parts are not exposed.

In addition, a rotation angle input to the main shaft 20 may be transmitted to the rotor 23 except a small amount of lost motion due to torsion. Accordingly, particularly when quantitative discharge of a liquid is required, high quantitativeness can be obtained when compared to the conventional Moineau pump in which power transmission parts such as a universal joint and a flex shaft are used.

In addition, in the conventional Moineau pump, since a chamber has a space for driving the power transmission parts such as the universal joint and the flex shaft, it is difficult to reduce a diameter and a length of the chamber. However, in the chamber 413 according to the embodiment of the present invention, when a diameter allowing the rotor 23 or the first and second shaft parts 21 and 22 connected to the main shaft 20 to move eccentrically and a length allowing the supply hole 412 and the slot hole 11 of the stator 10 to be connected to each other are secured, the Moineau pump-type quantitative liquid-discharging apparatus may operate, and a size thereof can be minimized. Since the chamber 413 has the space filled with a liquid for operating of the pump, an amount of a remaining liquid can be reduced by reducing a volume of the chamber.

The scope of the present invention in the art is not limited to the content and description of the embodiment described above. In addition, it is mentioned once again that the scope of the present invention is not limited by clear changes or substitutions in the art to which the present invention belongs.

REFERENCE NUMERALS

10: Stator
11: Slot Hole
111: One Side Inner Wall of Slot Hole
112: Other Side Inner Wall of Slot Hole
20: Main Shaft
21: First Shaft Part
22: Second Shaft Part
23: Rotor
211, 221: Rotary Shaft Parts
31, 32: First and Second Slide Bearings
311, 312: First and Second Bearing Holes
41, 42: First and Second Sliders
411, 421: First and Second Movement Grooves
412: Supply Hole
413: Chamber
50: Coupling Part
51: First Coupling Hub
52: Second Coupling Hub
53: Coupling Disc
511, 521: First and Second Coupling Protruding Parts
531, 532: First and Second Coupling Grooves
60: Stator Housing
70: Coupling Housing

What is claimed is:

1. A Moineau pump-type quantitative liquid-discharging apparatus comprising:

a stator in which a slot hole is formed, wherein the slot hole is a space in which a rotor moves and a liquid is transferred;

a main shaft including a first shaft part and a second shaft part, which are eccentric with respect to each other, and the rotor which extends from the first shaft part and is inserted into the slot hole;

a first slide bearing and a second slide bearing to which the first shaft part and the second shaft part are rotatably coupled, respectively; and a first slider and a second slider which guide the first and second slide bearings to move in directions to cross each other, wherein movement directions of the first and second slide bearings are perpendicular to an extension direction of the rotor, wherein the first and second sliders include a first movement groove and a second movement groove into which the first and second slide bearings are inserted and by which the movements of the first and second slide bearings are guided, respectively, and wherein the first and second movement grooves extend perpendicular to each other.

2. The Moineau pump-type quantitative liquid-discharging apparatus of claim 1, wherein:

the first and second movement grooves are formed at side surfaces of the first slider and the second slider facing each other, respectively; and the first slider includes a chamber in which guides a liquid to a space between the rotor and the slot hole, and a supply part through which the liquid is supplied to the chamber, in a side which is opposite to the side surface at which the first movement groove is formed.

3. The Moineau pump-type quantitative liquid-discharging apparatus of claim 2, wherein, when the first slider and the second slider are assembled, a sum of heights of the first and second movement grooves corresponds to a sum of heights of the first and second slide bearings.

4. The Moineau pump-type quantitative liquid-discharging apparatus of claim 2, wherein:

the stator is fixedly inserted into a stator housing to be integral with the stator housing; and the stator housing is coupled to the first slider to be replaceable.

5. The Moineau pump-type quantitative liquid-discharging apparatus of claim 1, wherein the main shaft is fixed to any one of the first and second slider bearings in an axial direction to not move in the axial direction.

6. The Moineau pump-type quantitative liquid-discharging apparatus of claim 5, wherein:

the first shaft part includes a first rotary shaft part rotatably coupled to a first bearing hole of the first slide bearing and the second shaft part includes a second rotary shaft part rotatably coupled to a second bearing hole of the second slide bearing;

the first rotary shaft part includes an annular protruding part protruding in a radial direction; and the first bearing hole is formed to be stepped such that the protruding part is inserted into the first bearing hole and fixed in the axial direction.

7. The Moineau pump-type quantitative liquid-discharging apparatus of claim 1, wherein:

the slot hole is formed to extend as a twin helices hole having two rows of screw thread;

the rotor is formed to have one screw thread, a lead of the rotor being a half of a lead of the twin helices hole;

in the main shaft, a center of a first rotary shaft part rotatably supported by the first slide bearing of the first shaft part is formed to match a center of any one arbitrary cross section in an axial direction of the rotor, and a center of a second rotary shaft part rotatably supported by the second slide bearing of the second shaft part is formed to match a center of a cross section in the axial direction which is spaced L/2 (L: a lead of the screw thread of the rotor) from the any one arbitrary cross section in the axial direction.

8. The Moineau pump-type quantitative liquid-discharging apparatus of claim 1, wherein the first and second movement grooves are formed to respectively allow the first and second slide bearings to each move at least an eccentric distance between centers of the first and second shaft parts of the main shaft from a central position of movement in the movement directions.

9. The Moineau pump-type quantitative liquid-discharging apparatus of claim 1, wherein the second shaft part of the main shaft includes a coupling connection part on an opposite end to the rotor, and the coupling connection part is connected to a coupling part which transmits rotation input from a driving unit allowing eccentricity.

10. The Moineau pump-type quantitative liquid-discharging apparatus of claim 9, further comprising a coupling housing accommodating the coupling part therein, wherein:

the coupling part includes a first coupling hub, a second coupling hub, and a coupling disc disposed between the first coupling hub and the second coupling hub, first and second coupling protruding parts are formed on side surfaces of the first and second coupling hubs which face each other, respectively, and first and second coupling grooves, into which the first and second coupling protruding parts are inserted and by which movements of the first and second coupling protruding parts are guided, respectively, are formed at side surfaces of the coupling disc, the first and second coupling grooves being formed to extend perpendicular to each other.

* * * * *